US011959491B2

(12) United States Patent
Xiao et al.

(10) Patent No.: US 11,959,491 B2
(45) Date of Patent: Apr. 16, 2024

(54) TOWER FAN AND AIR CHANNEL THEREFOR

(71) Applicant: Shenzhen Hesung Innovation Technology Co., Ltd., Shenzhen (CN)

(72) Inventors: Hongli Xiao, Shenzhen (CN); Xianglu Dai, Shenzhen (CN); AiMin He, Shenzhen (CN); Lihu Wei, Shenzhen (CN)

(73) Assignee: Shenzhen Hesung Innovation Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/086,564

(22) Filed: Dec. 21, 2022

(65) Prior Publication Data

US 2023/0287898 A1 Sep. 14, 2023

(30) Foreign Application Priority Data

Mar. 11, 2022 (CN) ..... 202210238739.0

(51) Int. Cl.
*F04D 29/40* (2006.01)
*F04D 29/70* (2006.01)

(52) U.S. Cl.
CPC ..... *F04D 29/403* (2013.01); *F04D 29/703* (2013.01)

(58) Field of Classification Search
CPC ..... F04D 29/403; F04D 29/703
See application file for complete search history.

(56) References Cited

FOREIGN PATENT DOCUMENTS

KR 102409238 B1 * 6/2022 ..... F24F 8/80

OTHER PUBLICATIONS

Machine Translation of KR102409238B1 PDF File Name: "KR102409238B1_Machine_Translation.pdf".*

* cited by examiner

*Primary Examiner* — Grant Moubry
*Assistant Examiner* — Ruben Picon-Feliciano
(74) *Attorney, Agent, or Firm* — David & Raymond Patent Firm; Raymond Y. Chan

(57) ABSTRACT

An air channel arrangement of a tower fan, arranged for accommodating an air blower therein, includes a housing having an air inlet, an air outlet and an air blower installation space therein, a volute shell and a volute member having a curved surface portion, wherein the volute shell and the curved surface portion of the volute member are arranged on two sides of the air outlet respectively such that, when the air blower is driven to rotate, the airflow is guided to flow through the air channel smoothly, so that the tower fan has excellent air supply efficiency and is able to prevent eddy airflow being formed in in the air channel and reduce working noise of the tower fan.

17 Claims, 5 Drawing Sheets

TOWER FAN AND AIR CHANNEL THEREFOR

CROSS REFERENCE OF RELATED APPLICATION

This application is a non-provisional application that claims the benefit of priority under 35U.S.C. § 119(e) to a Chinese application, application number 202210238739.0, filed Mar. 11, 2022, which is incorporated herewith by reference in its entirety.

BACKGROUND OF THE PRESENT INVENTION

Field of Invention

The present invention relates to electrical appliances, and more particularly to a tower fan and an air channel therefor.

Description of Related Arts

Tower fan, which is named because of its tower like slim and tall appearance, produces air pressure by means of a rotation of a cross-flow blower fan thereof and generates centrifugal airflow power according to the principle of airflow, wherein the airflow generated is transmitted through an internal air guiding configuration thereof to outside. Since the airflow produced by the tower fan is even and soft, very similar to the natural wind, it is more and more popular among consumers. However, the conventional tower fan generates abnormal noise often while in use that such loud noise causes unpleasant experience to the user.

The current airflow channel system of the tower fan includes a housing and cross-flow impellers rotatably arranged in the housing, wherein the housing has an air inlet, an air outlet, and a volute airflow channel defined between the air inlet and the air outlet for air circulation. Under the rotation of the cross-flow impeller, air is drawn to enter the housing through the air inlet and flows through the airflow channel to exit from the air outlet. Therefore, the shape of the housing directly affects the circulation of air in the airflow channel, wherein an unreasonable shape of the housing will lead to problems such as loud noise, poor air flow, and insufficient wind pressure in the conventional tower fan.

Specifically, during the operation of the tower fan, after the air enters from the air inlet and flows through the cross-flow impellers, the air is driven to blow along a tangential direction of the cross-flow impellers and hit an inner surface of the housing so as to be limited and guided by the housing. Accordingly, when the shape of the housing is unreasonably designed, the air is difficult to be smoothly and completely guided to the air outlet to flow out that portion of the air will flow backwards within the housing, wherein when the air flows back towards the air inlet, a vortex is formed with the air entering the air inlet to generate noise. At the same time, due to the backflow of the air, the amount of air flowing out of the air outlet is reduced that causes a shortcoming of insufficient air supply generally to the conventional tower fan. In addition, the air is limited and guided by the housing that, when a distance between the inner surface of the housing and the cross-flow impellers is too close, the air blowing by the cross-flow impellers will immediately hit the inner surface of the housing with a relatively higher airflow pressure that results an increase of the noise produced. When the distance between the inner surface of the housing and the cross-flow impellers is too far, the airflow pressure of the tower fan is small and the volume of air flow is reduced. In other words, the conventional tower fan fails to reasonably control the airflow pressure and the noise correspondingly.

SUMMARY OF THE PRESENT INVENTION

The invention is advantageous in that it provides a tower fan and an air channel therefor, wherein the air channel system of the tower fan can effectively guide the flow of air so as to enable the air flow smoothly in the air channel that is beneficial to increase a volume of airflow supply of the tower fan and reduce the working noise of the tower fan.

Another advantage of the invention is to provide a tower fan and an air channel therefor, wherein the tower fan has an air channel and includes an air blower, wherein the air channel has an air blower installation space arranged to accommodate and install the air blower, wherein the air channel has an air inlet and an air outlet, such that while the air blower rotates in the air blower installation space, air flows in the air channel via the air inlet and is guided to flow out through the air outlet, forming an air supply process of the tower fan.

Another advantage of the invention is to provide a tower fan and an air channel therefor, wherein the air channel is capable of guiding a flow of air so as to maintain the airflow to flow and deliver out through the air outlet smoothly and to ensure an air supply volume of the tower fan, and thus prevents the airflow therein from flowing backwards repeatedly and generating eddy flow that causes the tower fan to produce abnormal noise.

Another advantage of the invention is to provide an air channel and a tower fan, wherein the air channel can form the collection of the potential energy of the airflow, so as to ensure the wind pressure of the airflow sent out from the air outlet and the air supply volume of the tower fan.

Another advantage of the invention is to provide a tower fan and an air channel therefor, wherein the air blower has a cylindrical shape, corresponding to the cylindrical shape of the air blower installation space, wherein the air channel includes a volute member, which is arranged at a side of the air outlet and has a curved surface portion. The curved surface portion is a portion of a side surface of the cylindrical volute member such that the volute member is able to guide the airflow produced in the air channel according to the morphological configuration of the volute member so as to ensure the airflow in the air channel flowing smoothly.

Another advantage of the invention is to provide a tower fan and an air channel therefor, wherein a diameter of a bottom of the air blower installation space is R1, wherein a diameter of a bottom surface of the cylindrical volute member is larger than the diameter of the bottom surface of air blower installation space, wherein a radius of the bottom surface of the cylindrical volute member is R2, wherein R2 is greater than or equal to R1/10 and less than or equal to R1/9, so that the air flowing guiding effect of the volute member with respect to the airflow is ensured that facilitates a reduction of the striking and lapping of the airflow on the volute member during the flowing of air in the air channel, resulting in reduction of noise of the tower fan correspondingly and effectively.

Another advantage of the invention is to provide a tower fan and an air channel therefor, wherein the air channel includes a volute shell, wherein the volute shell and a volute member are correspondingly arranged at two sides of the air outlet respectively to form a guiding of air flowing with respect to each other, wherein during a working state of the tower fan, the air flowing in through the air inlet by means of a rotation of the air blower is guided to blow out along a tangential direction of the air blower and to strike on the volute shell that limits and guides the airflow flowing to the air outlet, wherein the airflow is further guided by the volute member to flow out through the air outlet, such that the airflow is able to smoothly flowing and circulating within the air channel to ensure a volume of the air supply and reduce working noise of the tower fan.

Another advantage of the invention is to a tower fan and an air channel therefor, wherein a minimum distance between the curved surface portion of the volute member and the air blower installation space is D1, wherein D1 is greater than or equal to 3 mm and less than or equal to 6 mm, so that a reasonable gap is retained between the volute member and the air blower to prevent the volute member from being too close to the air blower to cause excessive noise of the tower fan and to prevent the gap between the volute member and the air blower from being too large to weaken the airflow guiding capability of the volute member, so as to ensure an airflow pressure of the tower fan as well as a good airflow strength for the tower fan, and that the reasonable gap retained between the volute member and the air blower prevents a formation of eddy airflow in the air channel. Accordingly, the airflow strength and the noise level of the tower fan are accounted to achieve a balance.

Another advantage of the invention is to provide a tower fan and an air channel therefor, wherein a side curvature length of the curved surface portion is L1, wherein L1 is greater than or equal to R1/5 and less than or equal to 3R1/10, so that the performance of the air channel according to the morphological configuration of the volute member is further optimized, that avoids a power reduction of airflow in the air channel caused by excessive long of the edge curvature length of the curved surface portion and a reduction of the guiding ability of the airflow causing an adverse affection of the stability of the airflow at the air outlet due to excessive short of the edge curvature length of the curved surface portion, thereby the volume of air supply and the airflow strength of the tower fan are ensured.

Another advantage of the invention is to provide a tower fan and an air channel therefor, wherein a side of the curvature surface portion adjacent to the air outlet is an airflow facing side, wherein the curved surface portion is folded at a position distanced from the airflow facing side for (3/4±1/8) *L1 away from the air blower installation space to form a step configuration of the curved surface portion, so as to ensure the performance of the air channel by means of the guiding of the airflow according to the morphological configuration of the volute member.

Another advantage of the invention is to provide a tower fan and an air channel therefor, wherein the volute member further includes an airflow facing and diverting portion curvedly extending from the airflow facing side of the curved surface portion to a side of the air outlet in a direction gradually away from the air blower installation space, wherein the airflow facing and diverting portion provides a guiding to the airflow according to the morphological configuration thereof. In particular, while the air flowing in the air channel, the air blowing out along the tangential direction of the air blower strikes the volute shell and thus being limited and guided to flow to the position of the air outlet, and then is guided by the airflow facing and diverting portion of the volute member to flow out via the air outlet. Thereby, the performance of the air channel is optimized due to the morphological configuration of the volute member and the volume of air supply and the airflow strength are ensured.

Another advantage of the invention is to provide a tower fan and an air channel therefor, wherein the volute member further includes an airflow guiding diffuser portion extending from another side of the curved surface portion towards the air inlet in a direction gradually away from the air blower installation space, so as to optimize the performance of the air channel according to the morphological configuration of the volute member, wherein while the air flowing in the air channel, any airflow that is not guided by the airflow facing and diverting portion of the volute member to the air outlet forms a backflow of air which backflows along the volute member in the air channel and is diffused at the airflow guiding diffuser portion to reduce the kinetic potential energy of the backflow, thus avoiding the formation of eddy airflow with the inletting air in the air channel at the air inlet caused by excessive kinetic potential energy of the backflow and reducing the working noise of the tower fan.

Another advantage of the invention is to provide a tower fan and an air channel therefor, wherein the kinetic potential energy of the airflow flowing out through the air outlet is increased due to the guiding and diverting of the airflow by the airflow facing and diverting portion at the air outlet, and the airflow flowing out of the air outlet is guided reasonably to flow back smoothly, so as to avoid any airflow that has not flown out via the air outlet gathering at the air outlet that adversely affects the outlet of airflow of the tower fan so as to ensure a smooth flowing of air in the air channel and the performance of the air channel to avoid noise caused by uneven and unsmooth air flow in the air channel.

Another advantage of the invention is to provide a tower fan and an air channel therefor, wherein the volute shell includes an air intake portion and a flow guiding portion, wherein the air intake portion extends from a side of the volute shell adjacent to the air inlet to the air outlet in a direction gradually towards the air blower installation space, such that an airflow limiting configuration, having an enlarging and expanding shape, is defined in such a manner that, while the tower fan is in working state, air flowing in through the air inlet is guided to increase its kinetic potential energy by means of the rotation of the air blower while the airflow is limited due to a morphological configuration of the air intake portion of the volute shell so as to further increase the kinetic potential energy of the airflow in the air channel to ensure the volume of air supply and the airflow strength of the tower fan.

Another advantage of the invention is to provide a tower fan and an air channel therefor, wherein a side of the air intake portion adjacent to the air inlet is a heading side while the other side of the air intake portion is a tail side, wherein an included angle between a connecting line extended between the head side and a centerline of the air blower installation space on the same horizontal plane and a connecting line extended between the tail side and the centerline of the air blower installation space on the same horizontal plane is greater than or equal to 10° and less than or equal to 30°, so as to ensure a limiting ability of the volute shell with respect to airflow to assure the performance of the air channel.

Another advantage of the invention is to provide a tower fan and an air channel therefor, wherein the flow guiding portion is curvedly extended from the tail side of the air intake portion to the air outlet in a direction gradually away from the air blower installation space, so that a minimum distance D2 between the volute shell and the air blower installation space is defined at the tail side and a distance from the tail side towards the air outlet direction and the air blower installation space is gradually enlarged and expanded, thereby ensuring the air being smoothly guided to flow to the air outlet to assure the air flow in the air channel is even and smooth.

Another advantage of the invention is to provide a tower fan and an air channel therefor, wherein a minimum distance D2 between the volute shell and the air blower installation space is greater than or equal to 3 mm and less than or equal to 8 mm, so as to maintain a reasonable gap between the volute shell and the air blower, thereby preventing the volute shell from being too close to the air blower that causes excessive noise of the tower fan, preventing the formation of eddy airflow at the air inlet that is caused while the air is unable to evenly and smoothly flow in the air channel because the volute shell is positioned too close to the air blower, and avoiding excessive gap formed between the volute shell and the air blower that would weaken the airflow limiting ability of the volute shell, so as to ensure the airflow pressure of the tower fan and to assure the tower fan having a good airflow strength, such that the airflow strength and the noise level of the tower fan are accounted to achieve a balance.

Another advantage of the invention is to provide a tower fan and an air channel therefor, wherein a side of the curved surface portion extended from the airflow guiding diffuser portion is an airflow outlet side of the curved surface portion, wherein an included angle between a connecting line extended between the airflow outlet side and the centerline of the air blower installation space on the same horizontal plane and a connecting line extended between the head side of the air intake portion and the centerline of the air blower installation space on the same horizontal plane defines an air inlet angle of the air channel, wherein the air inlet angle is greater than or equal to 120° and less than or equal to 160°, so as to ensure sufficient air flowing into the air channel to assure the volume of air supply of the tower fan.

Another advantage of the invention is to provide a tower fan and an air channel therefor, wherein an included angle between a connecting line extended between the airflow facing side of the curved surface portion and the centerline of the air blower installation space on the same horizontal plane and a connecting line extended between a side extending from the flow guiding portion to the air outlet and the centerline of the air blower installation space on the same horizontal plane is an air outlet angle of the air channel, wherein the air outlet angle is greater than or equal to 20° and less than or equal to 40°, so as to avoid the air outlet angle being excessive small that causes over excessive resistance to the airflow and results in excessive noise of the tower fan, and avoid the air outlet angle being excessive large that causes insufficient guiding strength to the airflow and results in excessive small airflow strength, thereby the airflow strength and noise level are accounted to achieve a balance.

Another advantage of the invention is to provide a tower fan and an air channel therefor, wherein on the same horizontal plane, a distance between the head side of the air intake portion and the centerline of the air blower installation space in a vertical direction is greater than or equal to 4R1/5 and less than or equal to R1, and that a distance between the tail side of the air intake portion and the centerline of the air blower installation space in a vertical direction is greater than or equal to R1 and less than or equal to 6R1/5, so that a positional relationship between the volute shell and the air blower is capable of forming a reasonable guide to the airflow to ensure the performance of the air channel.

Another advantage of the invention is to provide a tower fan and an air channel therefor, wherein a width of the air outlet is L2, wherein the width L2 of the air outlet is greater than or equal to 5R1/9 and less than or equal to 6R1/9, so that the air outlet has a reasonable width so as to avoid the noise caused by the excessive resistance of the airflow caused by the excessively small width of the air outlet, and to prevent the width of the air outlet being excessive large that adversely affects the airflow limiting and results in excessive small airflow strength of the tower fan.

Another advantage of the invention is to provide a tower fan and air channel therefor, wherein the air outlet is provided with at least one grille element, wherein the number of the grille element is N, wherein N is an odd number, wherein the grille elements form a guide of airflow so that the airflow is capable of delivering out towards a predetermined direction.

Another advantage of the invention is to provide a tower fan and an air channel therefor, wherein N is 5 or 7, so that the grille elements form a reasonable guide for the airflow at the air outlet, wherein at least one of the grille elements which is facing one side of the volute member is arranged to have a convex protrusion, wherein a radius of the convex protrusion is R3 and a center angle of the convex protrusion is greater than or equal to 120° and less than or equal to 160°, wherein the number of the grille element that does not have the convex protrusion is greater than the number of the grille element do not have the convex protrusion, so as to provide a guide for the airflow based on the arrangement of the grille elements at the air outlet and reduce a flow distribution while the airflow passing through the grille elements to ensure a directionality and stability of the air supply from the tower fan.

Another advantage of the invention is to provide a tower fan and an air channel therefor, wherein a distance between the grille element provided with the convex protrusion and the volute member is smaller than a distance between the grille element without the convex protrusion and the volute member, so as to form a guide for the airflow based on the arrangement of the grille elements at the air outlet and reduce a flow diversion while the airflow passing through the grille elements to ensure the directionality and stability of the air supply from the tower fan.

Another advantage of the invention is to provide a tower fan and an air channel therefor, wherein a distance between two adjacent grille elements is greater than or equal to 6 mm and less than or equal to 9 mm, so as to reduce the airflow resistance under the assurance of operation and usage safety of the tower fan and thus ensuring the safety and performance of the tower fan.

According to the present invention, the foregoing and other objects and advantages are attained by an air channel arrangement, configured for accommodating an air blower, including:

- a housing, having an air inlet, an air outlet and an air blower installation space therein, wherein the air blower installation space is arranged for accommodating the air blower and has a cylindrical shape and a bottom surface having a diameter R1;
- a volute shell; and
- a volute member having a curved surface portion, wherein the volute shell and the volute member are correspondingly arranged on two sides of the air outlet respectively, wherein the curved surface portion of the volute member is a partial side surface of a cylindrical body, wherein a radius of a bottom surface of the cylindrical body that is provided with the curved surface portion is R2, wherein R1/10≤ R2≤ R1/9.

In one embodiment, a minimum distance between the curved surface portion and the air blower installation space is greater than or equal to 3 mm and less than or equal to 6 mm.

In one embodiment, a minimum distance between the curved surface portion and the air blower installation space is equal to 4 mm.

In one embodiment, a curved edge length of the curved surface portion is L1, wherein R1/5 ≤ L1≤ 3R1/10.

In one embodiment, L1=R1/4.

In one embodiment, a side of the curved surface portion adjacent to the air outlet is an airflow facing side, wherein the curved surface portion is folded at a position distanced from the airflow facing side for (3/4±1/8) L1 away from the air blower installation space to form a step configuration of the curved surface portion.

In one embodiment, the volute member includes an airflow facing and diverting portion which is curvedly extended from the airflow facing side of the curved surface portion towards the air outlet in a direction gradually away from the air blower installation space.

In one embodiment, the volute member includes an airflow guiding diffuser portion extending from another side of the curved surface portion towards the air inlet in a direction gradually away from the air blower installation space.

In one embodiment, the volute shell includes an air intake portion which is extended from a side of the volute shell adjacent to the air inlet to the air outlet in a direction gradually towards the air blower installation space.

In one embodiment, a side of the air intake portion adjacent to the air inlet is a heading side while the other side of the air intake portion is a tail side, wherein an included angle between a connecting line of the head side and a centerline of the air blower installation space on the same horizontal plane and a connecting line of the tail side and the centerline of the air blower installation on the same horizontal plane is greater than or equal to 10° and less than or equal to 30°.

In one embodiment, the included angle between the connecting line of the head side and the centerline of the air blower installation space on the same horizontal plane and the connecting line of the tail side and the centerline of the air blower installation on the same horizontal plane is equal to 15°.

In one embodiment, on the same horizontal plane, a distance between the head side of the air intake portion and the centerline of the air blower installation space in a vertical direction is greater than or equal to 4R1/5 and less than or equal to R1, and that a distance between the tail side of the air intake portion and the centerline of the air blower installation space in a vertical direction is greater than or equal to R1 and less than or equal to 6R1/5.

In one embodiment, the volute shell includes a flow guiding portion which is curvedly extended from the tail side of the air intake portion to the air outlet in a direction gradually away from the air blower installation space.

In one embodiment, a minimum distance between the volute shell and the air blower installation space is greater than or equal to 3 mm and less than or equal to 8 mm.

In one embodiment, the minimum distance between the volute shell and the air blower installation space is equal to 5 mm.

In one embodiment, an included angle between a connecting line extended between the airflow outlet side and the centerline of the air blower installation space on the same horizontal plane and a connecting line extended between the head side of the air intake portion and the centerline of the air blower installation space on the same horizontal plane defines an air inlet angle of the air channel, wherein the air inlet angle is greater than or equal to 120° and less than or equal to 160°.

In one embodiment, an included angle between a connecting line of the airflow facing side of the curved surface portion and the centerline of the air blower installation space on the same horizontal plane and a connecting line of a side extending from the flow guiding portion to the air outlet and the centerline of the air blower installation space on the same horizontal plane is an air outlet angle of the air channel, wherein the air outlet angle is greater than or equal to 20° and less than or equal to 40°.

In one embodiment, a width of the air outlet is greater than or equal to 5R1/9 and less than or equal to 6R1/9.

In one embodiment, the air outlet is provided with at least one grille element, wherein the number of the grille element is N, wherein N is an odd number.

In one embodiment, N is 5 or 7.

In one embodiment, a distance between two adjacent grille elements is greater than or equal to 6 mm and less than or equal to 9 mm.

In one embodiment, at least one of the grille elements which is facing one side of the volute member is arranged to have a convex protrusion, wherein a radius of the convex protrusion is R3 and a center angle of the convex protrusion is greater than or equal to 120° and less than or equal to 160°.

In one embodiment, a distance between the grille element provided with the convex protrusion and the volute member is smaller than a distance between the grille element without the convex protrusion and the volute member.

In one embodiment, the number of the grille element that has the convex protrusion is greater than the number of the grille element do not have the convex protrusion.

In one embodiment, N is 5, the number of the grille element provided with the convex protrusion is 3.

According to another aspect of the present invention, the present invention provides a tower fan, including:

an air channel which includes:

a housing, having an air inlet, an air outlet and an air blower installation space therein, wherein the air blower installation space has a cylindrical shape and a bottom surface having a diameter R1;

a volute shell; and a volute member having a curved surface portion, wherein the volute shell and the volute member are correspondingly arranged on two sides of the air outlet respectively, wherein the curved surface portion of the volute member is a partial side surface of a cylindrical body, wherein a radius of a bottom surface of the cylindrical body that is provided with the curved surface portion is R2, wherein R1/10≤ R2≤ R1/9 an air blower accommodated in the air blower installation space of the air channel; and a motor configured to drive the air blower to rotate in such a manner that when the air blower rotates, an airflow is driven to enter the air channel through the air inlet and is guided to flow out through the air outlet to provide an air supply for the tower fan.

Still further objects and advantages will become apparent from a consideration of the ensuing description and drawings.

These and other objectives, features, and advantages of the present invention will become apparent from the following detailed description, the accompanying drawings, and the appended claims.

Figure 1:
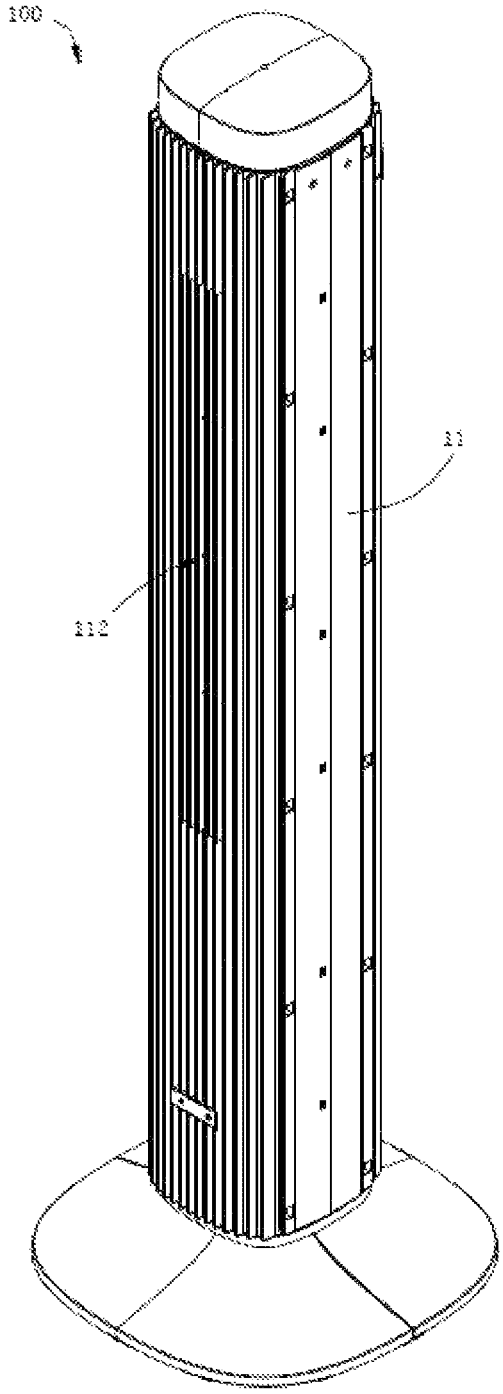
FIG. 1 is a perspective view of a tower fan according to a preferred embodiment of the present invention.
Figure 2:
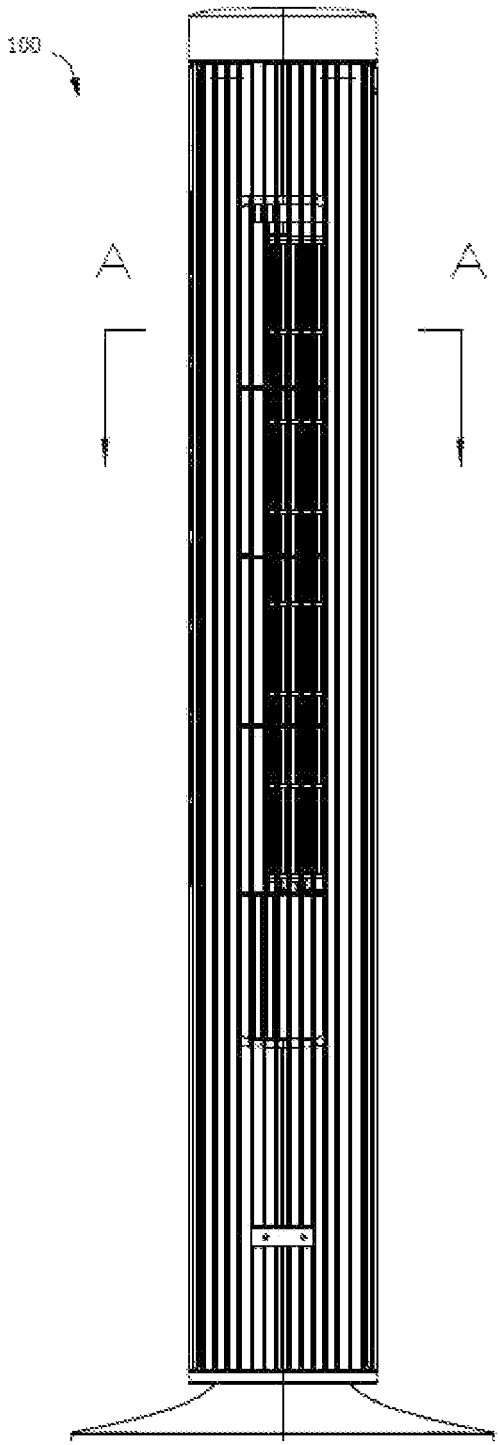
FIG. 2 is a front view of the tower fan according to the above preferred embodiment of the present invention.

The drawings, described above, are provided for purposes of illustration, and not of limitation, of the aspects and features of various examples of embodiments of the invention described herein. The drawings are not intended to limit the scope of the claimed invention in any aspect. For simplicity and clarity of illustration, elements shown in the drawings have not necessarily been drawn to scale and the dimensions of some of the elements may be exaggerated relative to other elements for clarity.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It should be understood by those skilled in the art that, in the disclosure of the present invention, the terms "vertical", "horizontal", "upper", "lower", "front", "rear", "left", "right", the orientation or positional relationship indicated by "vertical", "horizontal", "top", "bottom", "inner", "outer", etc. is based on the orientation or positional relationship shown in the accompanying drawings, which are only for the convenience of describing the present invention. The invention and simplified description are not intended to indicate or imply that the device or element referred to must have a particular orientation, be constructed and operate in a particular orientation, and thus the above terms should not be construed as limiting the invention.

It should be understood that the term "a" should be understood as "at least one" or "one or more", that is, in one embodiment, the number of one element may be one, while in another embodiment, the number of the elements may be multiple, and the term "one" cannot be understood as a limitation on the number.

In the description of the present invention, it should be noted that unless otherwise specified and defined, the terms "installation", "connection" and "connection" should be understood in a broad sense, for example, they can be fixed connection, detachable connection, or integrated connection; It can be mechanical connection, electrical connection or mutual communication; It can be directly connected or indirectly connected through an intermediate medium. It can be the connection between two elements or the interaction between two elements. For those skilled in the art, the specific meaning of the above terms in the present invention can be understood according to specific circumstances.

Referring to FIG. 1 to FIG. 8, a tower fan 100 according to a preferred embodiment of the present invention is illustrated, wherein the tower fan 100 includes an air channel 1 and a cylindrical air blower 2, wherein the air blower 2 is accommodated in the air channel 1 in such a manner that, when the air blower 2 is rotated, an airflow which is generated to flow through the air channel is guided by the air channel 1, forming an air supply process of the tower fan 100, wherein the configuration of the air channel 1 enables the airflow smoothly flowing in the air channel 1, so as to ensure the tower fan 100 has an excellent air supply efficiency and a smooth flow or air to prevent a formation of eddy airflow in the air channel 1, thereby reducing the working noise of the tower fan 100, especially avoiding undesirable air noise due to uneven and unsmooth circulation and flowing of air.

Specifically, the air channel 1 includes a housing 11, which has an air blower installation space configured to be capable of accommodating the air blower 2, wherein the air blower 2 has a cylindrical shape. Correspondingly, the air blower installation space is a straight and cylindrical space, such that the air blower installation space is the space occupied by the air blower 2 when the air blower 2 is accommodated in the air channel 1, wherein the housing 11 has an air inlet 111 and an air outlet 112 arranged in a such manner that when the air blower 2 is driven to rotate in the air blower installation space, the airflow flows into the air channel 1 from the air inlet 111 and is guided to flow to the air outlet 112 according to the morphological configuration of the air channel 1, forming the air supply process of the tower fan 100.

Further, the air channel 1 includes a volute shell 12 and a volute member 13, wherein the volute shell 12 and the volute member 13 are arranged in the housing 11. In particular, the volute shell 12 and the volute member 13 are opposingly and correspondingly arranged on two sides of the air outlet 112 respectively, such that the volute shell 12 and the volute member 13 incorporate with each other to provide a guiding of the airflow within the housing 11, so as to ensure a smooth flow of the airflow in the air channel 1. In which, while the impellor of the air blower 2 is driven to rotate in the air blower installation space, the airflow is driven to enter the air channel 1 through the air inlet 111 of the housing 11 and blow out by means of the rotating air blower 2 to flow along a tangential direction of the air blower 2 to strike on an inner surface of the volute shell 12 such that the airflow is limited and guided to flow towards the air outlet 112, where the airflow is guided by the volute member 13 to discharge through the air outlet 112. Accordingly, the airflow is capable of smoothly flowing through the air channel 1, thereby ensuring a volume of the air supply of the tower fan 100 and reducing the working noise of the tower fan 100.

It is worth mentioning that, according to the shapes and configurations of the volute shell 12 and the volute member 13 as well as the corresponding arrangement of the volute shell 12 and the volute member 13 with each other, the air channel 1 defines and forms a guiding of the airflow therein, so as to ensure the airflow being guided to flow out through the air outlet 112, preventing backflow of the air repeatedly in the air channel 1 and avoiding the formation of eddy airflow that causes abnormal noise of the tower fan 100. In addition, since the air channel 1 is able to provide a collection of kinetic potential energy of the airflow, the airflow pressure of the airflow flowing out through the air outlet 112 is ensured that significantly assures a volume of air supply of the tower fan 100.

Figure 3:
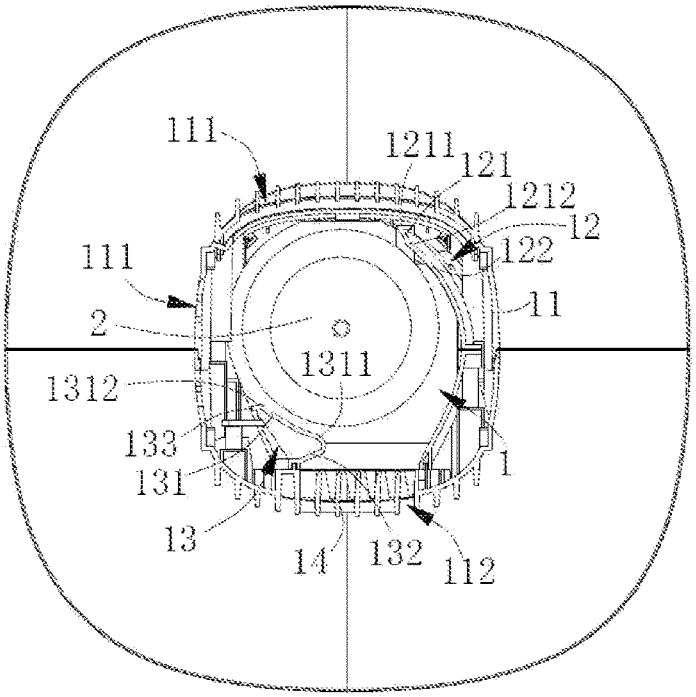
FIG. 3 is a cross-sectional view taken along line A-A of FIG. 2 of the tower fan according to the above preferred embodiment of the present invention.
Figure 4:
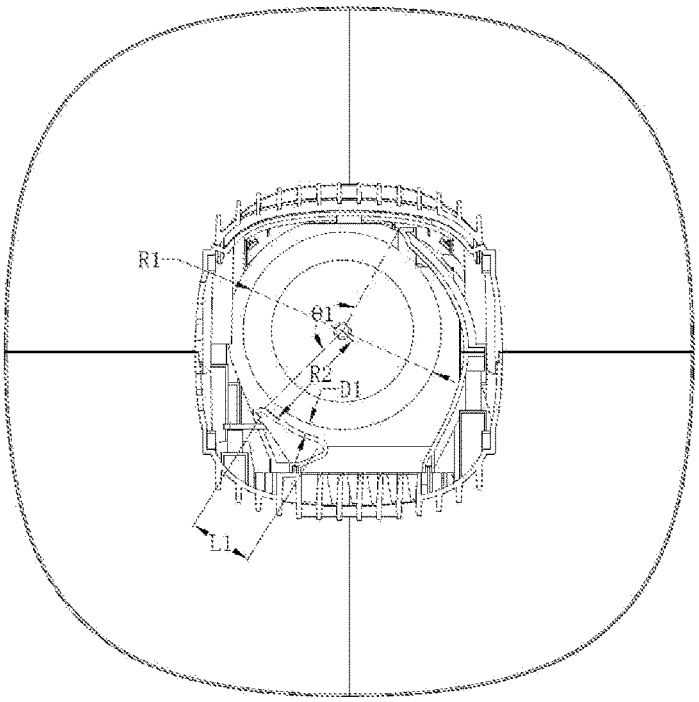
FIG. 4 is a schematic diagram illustrating a relationship of relevant elements of the tower fan according to the above preferred embodiment of the present invention.

Specifically, referring to FIG. 3 of the drawings, the volute member 13 has a curved surface portion 131, which is a partial side surface of a volute cylindrical body, so that the volute member 13 is able to guide the airflow in the air channel 1 based on a morphological configuration thereof, wherein a positional relationship between the volute member 13 and the air blower installation space is a factor to the performance of the air channel 1, i.e. the positional relationship between the volute member 13 and the air blower 2 is relevant to the performance of the air channel 1. Referring to FIG. 4, a diameter of a bottom of the air blower installation space is R1, wherein a diameter of the volute cylindrical body where the curved surface portion 131 is provided is larger than the diameter of the bottom of the air blower installation space, wherein a radius of the bottom surface of the volute cylindrical body is R2. Preferably, R2 is greater than or equal to R1/10 and less than or equal to R1/9, such that the positional relationship between the volute member 13 and the air blower 2 is reasonably and effectively arranged that ensues an airflow guiding effect of the volute member 13 on the airflow is ensured and reduces the striking and lapping of the airflow on the volute member 13 during the flowing movement of the airflow, resulting in effective reduction of the noise of the tower fan 100.

Furthermore, an edge curvature length of the curved surface portion 131 affects the efficiency of the volute member 13 with respect to the airflow, wherein an excessive long of the edge curvature length of the curved surface portion 131 will cause a reduction of an impetus of the airflow in the air channel 1 that adversely affects the volume of air supply of the tower fan 100, wherein an excessive short of the edge curvature length of the curved surface portion 131 renders the volute member 13 failing to provide desired effect to airflow that adversely affects the performance of the air channel 1. Accordingly, while the edge curvature length of the curved surface portion 131 is L1, the edge curvature length L1 of the curved surface portion 131 is greater than or equal to R1/5 and less than or equal to 3R1/10, so as to ensure a reasonable size of the curved surface portion 131 and an effective performance of the air channel 1, that is to prevent the impetus of the airflow in the air channel 1 from decreasing to adversely affect the volume of the air supply of the power fan 100 for the edge curvature length L1 of the curved surface portion 131 is too long, and prevent the stability of the airflow at the air outlet 112 from being adversely affected due to the reduction of the guiding ability of the volute member 13 to the airflow for the edge curvature length L1 of the curved surface portion 131 is too short, thereby ensuring the volume of air supply and the airflow strength of the tower fan 100.

Preferably, according to the preferred embodiment of the present invention, the edge curvature length L1 of the curved surface portion 131 is arranged to be equal to R1/4, so that the air channel 1 has a sufficient cross-flow area to increase the airflow of the air blower 2 and ensure the volume of air supply of the tower fan 100.

Further, the volute member 13 includes an airflow facing and diverting portion 132 and an airflow guiding diffuser portion 133 which are shaped and configured to ensure the diverting and guiding abilities of the volute member 13 with respect to the airflow so as to assure the performance of the air channel 1.

Specifically, one side of the curved surface portion 131 adjacent to the air outlet 112 is an airflow facing side 1311 of the curved surface portion 131, and another side of the curved surface portion 131 is an airflow outlet side 1312 of the curved surface portion 131, wherein the airflow facing and diverting portion 132 is curvedly extended from the airflow facing side 1311 of the curved surface portion 131 to one side of the air outlet 112 in a direction gradually away from the air blower installation space, so as to provide a guiding to the airflow according to the morphological configuration of the airflow outlet side 1312 and a relative position of the airflow outlet side 1312 in the air channel 1. Specifically, during the movement of the airflow in the air channel 1, the airflow blows out along a tangential direction of the air blower 2 to flow onto an inner surface of the volute shell 12 that substantially limits and guides the airflow to flow towards the air outlet 112 where the airflow is guided by the airflow facing and diverting portion 132 of the volute member 13 to flow out the housing 11 through the air outlet 112, thereby improving the performance of the air channel 1 according to the morphological configuration of the volute member 13 and ensuring the volume of air supply and airflow strength of the tower fan 100.

In particular, the airflow guiding diffuser portion 133 curvedly extends from the airflow outlet side 1312 of the curved surface portion 131 toward the air inlet 111 in a direction gradually away from the air blower installation space in such a manner that the airflow can be diffused thereby so as to optimize the performance of the air channel 1 according to the morphological configuration of the airflow guiding diffuser portion 133 and the corresponding position of the airflow guiding diffuser portion 133 in air channel 1. However, while the airflow flowing in the air channel 1, a portion of the airflow may not be guided to the air outlet 112 by the airflow facing and diverting portion 132 of the volute member 13 and form a backflow of the airflow. In particular, when the airflow moves to the airflow facing and diverting portion 132 of the volute member 13 from the air outlet 112, the curved morphological configuration of the airflow facing and diverting portion 132 enables a diversion of the airflow to avoid the airflow from strongly striking and lapping on the volute member 13 under the action of the kinetic potential energy of the airflow while being guided to the air outlet 112 that would generate undesirable noise, wherein the backflow formed by the airflow not being guided to the air outlet 112 moves along the curved surface portion 131 of the volute member 13 in the air channel 1 and is diffused at the airflow guiding diffuser portion 133 of the volute member 13 due to the morphological configuration of the airflow guiding diffuser portion 133, thereby reducing the kinetic potential energy of the backflow to prevent the kinetic potential energy of the backflow from being too large to form an eddy airflow with the air flowing into the air channel 1 through the air inlet 111 so as to reduce the working noise of the tower fan 100.

It is worth mentioning that, according to the guiding and diverting of the airflow at the air outlet 112 by the airflow facing and diverting portion 132, the kinetic potential energy of the airflow flowing out through the air outlet 112 is increased, and the airflow not flowing out of the air outlet 112 is reasonably and effectively guided to smoothly flow back to prevent the airflow gathering at the air outlet 112 to adversely affects the discharging of air through the air outlet 112 so as to ensure a smooth flow of air in the air channel 1 that asserts the performance of the air channel 1 and prevents noise generated due to the uneven and unsmooth flow of the air in the air channel 1.

In particular, a distance between the volute member 13 and the air blower 2 is a relevant factor to the performance of the tower fan 100, i.e. the distance between the volute member 13 and the air blower installation space is related to the performance of the air channel 1. Specifically, although the volute member 13 which is excessively close to the air blower installation space can increase the air pressure of the airflow in the air channel 1, the noise of the tower fan 100 is increased correspondingly too. Also, an excessive long distance between the volute member 13 and the air blower installation space will cause the volute member 13 failing to provide sufficient ability to act on the airflow and adversely affecting the performance of the air channel 1. Accordingly, it is essential to the overall performance of the tower fan 1 to retain a reasonable gap between the volute member 13 and the air blower 2, wherein according to the preferred embodiment of the present invention, a minimum distance between volute member 13 and the air blower installation space is located at the curved surface portion 131.

It is worth mentioning that the minimum distance between the curved surface portion 131 of the volute member 13 and the air blower installation space is D1, wherein D1 is greater than or equal to 3 mm and less than or equal to 6 mm, so that a reasonable gap between the volute member 13 and the air blower 2 is retained that avoids the volute member 13 from being too close to the air blower 2 and causing excessive noise of the tower fan 100, and prevents the gap between the volute member 13 and the air blower 2 from being too large and weakening an operation ability of the volute member 13 acting to the airflow, so as to ensure the airflow pressure of the tower fan 100 and the tower fan 100 is capable of having a good airflow strength. At the same time, the reasonable gap retained between the volute member 13 and the air blower 2 significantly prevents eddy airflow being formed in the air channel 1, so that the airflow strength and the noise level of the tower fan 100 are accounted to achieve a balance.

Preferably, according to the preferred embodiment of the present invention, the minimum distance D1 between the curved surface portion 131 and the air blower installation space is set to be equal to 4 mm, so that the airflow strength and the noise level of the tower fan 100 are accounted to achieve a preferred balance.

In particular, the curved surface portion 131 is folded away from the air blower installation space at a position (3/4±1/8)*L1 distanced from the airflow facing side 1311 to form a step configuration of the curved surface portion 131 for guiding the airflow according to the morphological configuration of the volute member 13 to further optimize the performance of the air channel 1.

It is worth mentioning that the curved surface portion 131 is made in form of the step configuration that, during the movement of the airflow, the backflow of the airflow moves along the curved surface portion 131 and is diffused by the step configuration thereof to weaken the kinetic potential energy of the backflowing airflow, such that when the backflowing airflow flows to the airflow guiding diffuser portion 133, the kinetic potential energy of the backflowing airflow is further weakened due to the morphological configuration of the airflow guiding diffuser portion 133, so as to avoid that the kinetic potential energy of the backflow is too large to form an eddy airflow with the air flowing into the air channel 1 through the air inlet 111 that correspondingly prevents the noise caused by the eddy airflow being generated in the air channel 1.

Further, the air channel 1 also allows the airflow to be guided by the morphological configuration of the volute shell 12. Referring to FIG. 3, according to the preferred embodiment of the present invention, the volute shell 12 includes an air intake portion 121, wherein the air intake portion 121 extends from a side of the volute shell 12 adjacent to the air inlet 111 to the air outlet 112 in a direction gradually towards the air blower installation space, such that an airflow limiting configuration, having an enlarging and expanding shape, is defined in such a manner that, while the tower fan 100 is in working state, air flowing in through the air inlet 111 is guided to increase its kinetic potential energy by means of rotation of the air blower 2 while the airflow is limited due to a morphological configuration of the air intake portion 121 of the volute shell 12 so as to further increase the kinetic potential energy of the airflow in the air channel 1 to ensure the volume of air supply and the airflow strength of the tower fan 100.

Figure 5:
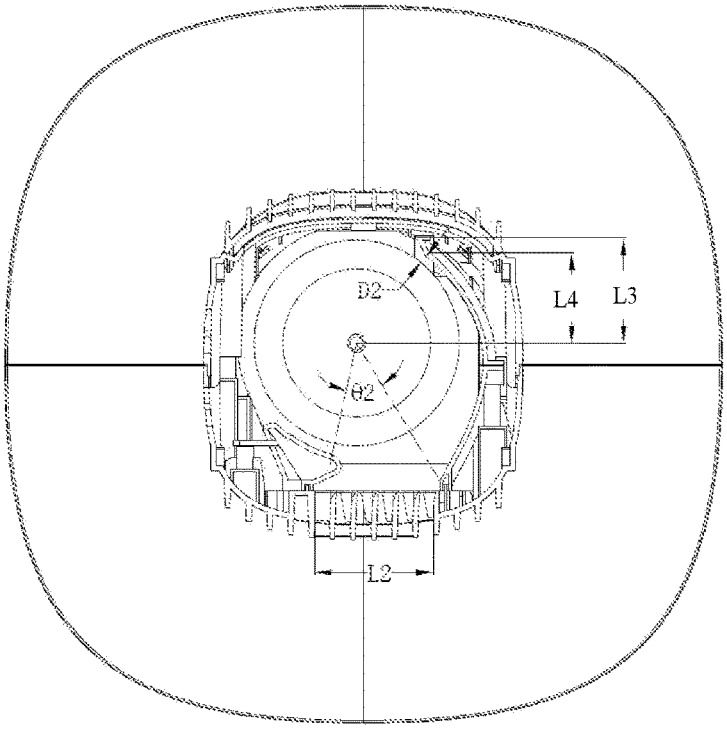
FIG. 5 is a schematic diagram illustrating the relationship of relevant elements of the tower fan according to the above preferred embodiment of the present invention.
Figure 6:
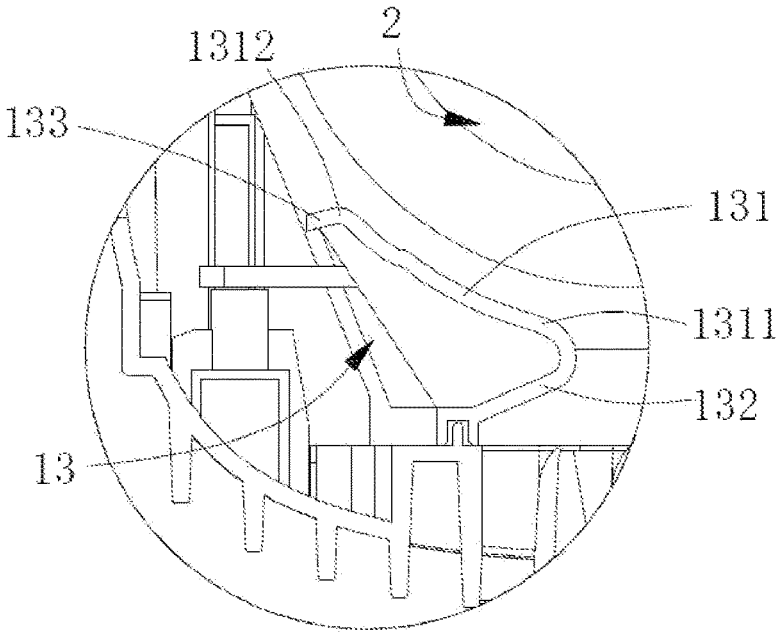
FIG. 6 is a partial enlarged schematic view of the tower fan according to the above preferred embodiment of the present invention.
Figure 7:
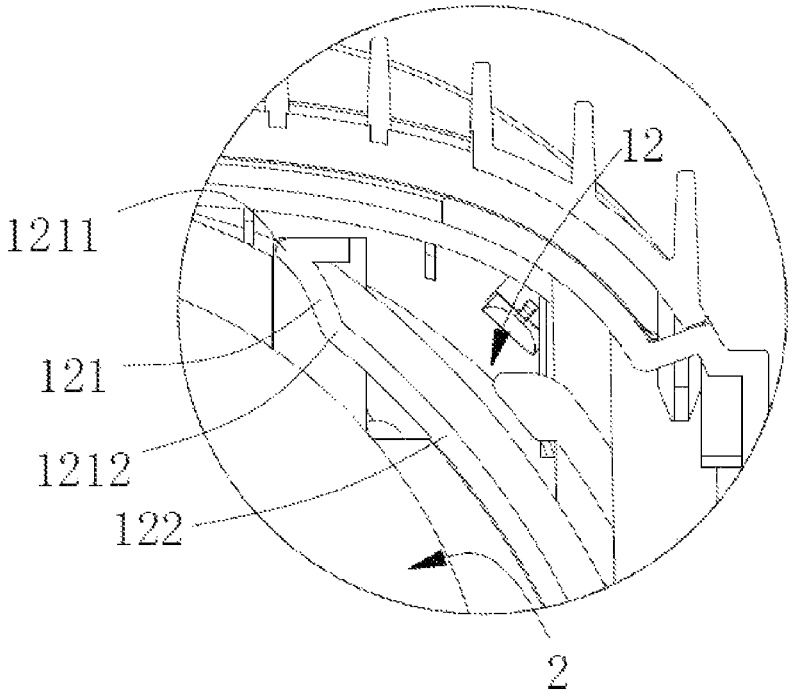
FIG. 7 is a partial enlarged schematic view of the tower fan according to the above preferred embodiment of the present invention.

In particular, referring to FIG. 3 to FIG. 5, the shape, configuration and size of the air intake portion 121 affect the performance of the air channel 1, wherein a side of the air intake portion 121 adjacent to the air inlet 111 is a head side 1211, while the other side of the air intake portion 121 is a tail side 1212, wherein an included angle between a connecting line extended between the head side 1211 and a centerline of the air blower installation space on the same horizontal plane and a connecting line extended between the tail side 1212 and a centerline of the air blower installation space on the same horizontal plane is greater than or equal to 10° and less than or equal to 30° (≥10° and ≤30°), so as to ensure a limiting ability of the volute shell 12 with respect to the airflow to assure the performance of the air channel 1.

It is worth mentioning that, on the same horizontal plane, a distance in a vertical direction between the head side 1211 of the air intake portion 121 and the centerline of the air blower installation space is L3, wherein the distance L3 is greater than or equal to 4R1/5 and less than or equal to R1 (≥4R1/5 and ≤R1). Also, a distance between the tail side 1212 of the air intake portion 121 and the centerline of the air blower installation space in a vertical direction is L4, wherein the distance L4 is greater than or equal to R1 and less than or equal to 6R1/5 (≥R1 and ≤6R1/5), so that a positional relationship between the volute shell 12 and the air blower 2 is able to provide a reasonable guide for the airflow and ensure the performance of the air channel 1.

Further, the volute shell 12 includes a flow guiding portion 122, wherein the flow guiding portion 122 is curvedly extended from the tail side 1212 of the air intake portion 121 to the air outlet 112 where a distance from the tail side 1212 of the volute shell 12 towards the air outlet 112 and the air blower installation space is gradually increased, such that a minimum distance D2 between the volute shell 12 and the air blower 2 is located at the tail side 1212. Accordingly, during the operation of the tower fan 100, the airflow is limited by the morphological configuration of the air intake portion 121 of the volute shell 12 to flow along the volute shell 12 in a direction towards the air outlet 112, and is diffused and guided to flow to the air outlet 112 by the flow guiding portion 122 of the volute shell 12. At the same time, since the distance between the volute shell 12 and the air blower installation space, in the direction from the tail side 1212 towards the air outlet 112, is gradually enlarged and expanded, roaring noise caused by a constant distance between the volute shell 12 and the air blower 2 of the conventional tower fan during the movement of the airflow along the volute shell 12 is avoided, thereby reducing the working noise of the tower fan 100.

It is worth mentioning that the distance between the air intake portion 121 and the air blower 2 substantially affects the performance of the tower fan 100. Specifically, although a closer distance between the air intake portion 121 and the air blower 2 can enhance the limiting ability of the air intake portion 121 with respect to the airflow, the gathering airflow will also generate noise at the same time. Similarly, although the increasing of the distance between the air intake portion 121 and the air blower 2 is beneficial to reduce the gathering of airflow, the acting ability of the air intake portion 121 with respect to the airflow reduces at the same time that adversely affects the flowing of airflow in the air channel 1. Accordingly, according to the preferred embodiment of the present invention, the minimum distance D2 between the volute shell 12 and the air blower installation space is greater than or equal to 3 mm and less than or equal to 8 mm (≥3 mm and ≤8 mm), so as to retain a reasonable gap between the volute shell 12 and the air blower 2 to prevent the volute shell 12 from being too close to the air blower 2 and causing excessive noise of the tower fan 100, thereby preventing the formation of eddy airflow at the air inlet 111 due to the uneven and unsmooth flowing of air in the air channel 1 caused by excessive small gap between the volute shell 12 and the air blower 2 and avoiding the weakening of the limiting ability of the volute shell 12 due to the excessive large gap between volute shell 12 and the air blower 2. Therefore, the airflow strength and the noise level of the tower fan 100 are accounted to achieve a balance and the utility of the tower fan 100 is enhanced.

Preferably, in the preferred embodiment of the present invention, the minimum distance D2 between the volute shell 12 and the air blower installation space is set to be equal to 5 mm, so that the airflow strength and the noise level of the tower fan 100 are accounted to achieve a preferable balance.

Further, referring to FIG. 3 and FIG. 4, an intake angle range is constituted by the positional relationship between the volute member 13 and the volute shell 12 while the air blower 2 is accommodated in the air channel 1. Specifically, an included angle between the connecting line extended between the airflow outlet side 1312 of the curved surface portion 131 and the centerline of the air blower installation space on the same horizontal plane and the connecting line extended between the head side 1211 of the air intake portion 121 and the centerline of the air blower installation space on the same horizontal plane is the air inlet angle θ1 of the air channel 1, wherein the air inlet angle θ1 is greater than or equal to 120° and less than or equal to 160° (≥120° and ≤160°) so that the air blower 2 has a sufficient air inlet angle range to ensure sufficient air flowing into the air channel 1 to assure the volume of air supply of the tower fan 100.

In particular, referring to FIG. 3 and FIG. 5, an included angle between a connecting line extended between the airflow facing side 1311 of the curved surface portion 131 and the centerline of the air blower installation space on the same horizontal plane and a connecting line extended between a side extending from the flow guiding portion 122 to the air outlet 112 and the centerline of the air blower installation space on the same horizontal plane is an air outlet angle θ2 of the air channel 1, wherein the air outlet angle θ2 is greater than or equal to 20° and less than or equal to 40° (≥20° and) ≤40°, so as to avoid the air outlet angle θ2 being too small that causes too much resistance to the airflow resulting too much noise of the tower fan 100, and avoid the air outlet angle θ2 being too large that causes insufficient guiding ability to the airflow resulting excessive small airflow strength of the tower fan 100. Accordingly, the airflow strength and the noise level of the tower fan 100 are accounted to achieve a balance.

Further, under the limitation of the air outlet angle θ2, the size of the air outlet 112 would directly affect the wind force of the tower fan 100, wherein a width of the air outlet 112 is L2, wherein the width L2 of the air outlet 112 is greater than or equal to 5R1/9 and less than or equal to 6R1/9 (≥5R1/9 and ≤6R1/9), so that the air outlet 112 has a reasonable and effective width to avoid the noise caused by excessive resistance to the airflow caused by excessively small width of the air outlet 112, and to prevent the airflow strength of the tower fan 100 from being too small caused by excessively large width of the air outlet 112 that adversely affects the limiting of the flowing of air. Accordingly, the airflow strength and the noise level of the tower fan 100 are accounted to achieve a balance.

Figure 8:
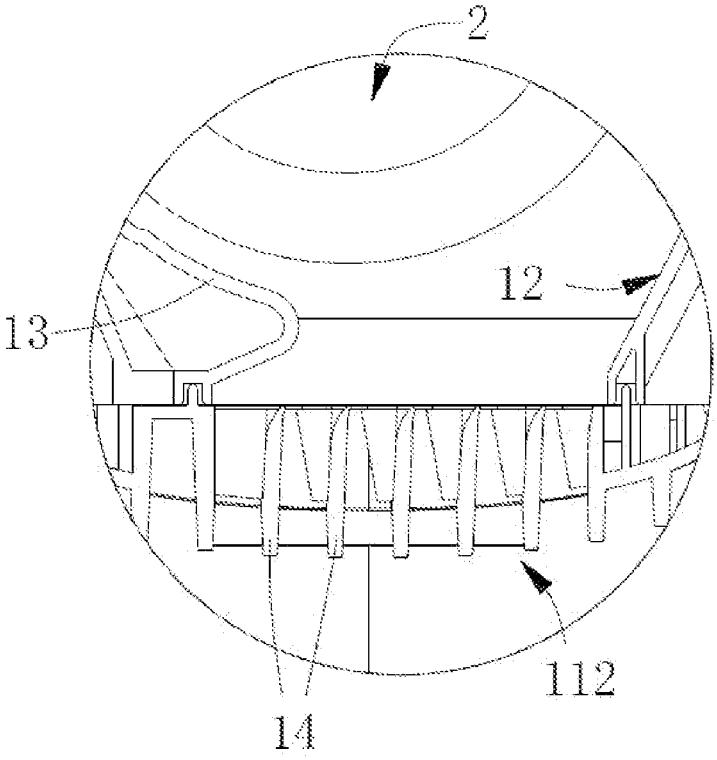
FIG. 8 is a partial enlarged schematic view of the tower fan according to the above preferred embodiment of the present invention.

In particular, referring to FIG. 8, the tower fan 100 includes at least one grille element 14 arranged at the air outlet 112, wherein the number of the grille element 14 is N and N is an odd number, wherein the at least one grille element 14 at the air outlet 112 provides a guiding to the airflow to be discharged out from the air channel 1 so as to allow the airflow to flow out in a predetermined direction. Since the airflow at different positions of the air outlet 112 may have different flowing directions, the grille elements 14 arranged at the air outlet 112 may be stroked by airflow in different directions and with different strengths, so that the reaction ability of the grille elements 14 will be different too. Accordingly, according to the preferred embodiment of the present invention, the grille elements 14 are configured with different shapes and configurations at the air outlet 112 to provide appropriate guiding and reaction abilities to the airflow correspondingly. Specifically, at least one of the grille elements 14 which is facing one side of the volute member 13 is arranged to have a convex protrusion, wherein a radius of the convex protrusion is R3 and a center angle of the convex protrusion is greater than or equal to 120° and less than or equal to 160°, so as to provide an appropriate guide to the airflow flowing through the grille element 14 having the convex protrusion according to the morphological configuration thereof.

Specifically, N is preferably 5 or 7 to enable the grille elements 14 forming a reasonable guide to the airflow at the air outlet 112, wherein a distance between the grille element 14 provided with the convex protrusion and the volute member 13 is smaller than a distance between the grille element 14 not provided with the convex protrusion and the volute member 13. That is, the grille element 14 provided with the convex protrusion is closer to the volute member 13 than the grille element 14 not provided with the convex protrusion. It is because, during the air flowing movement, the airflow would be gradually deflected from one side of the air outlet 112 close to the volute shell 12 to the other side under the effect of the kinetic potential energy, so as to provide a guiding effect to the airflow through the arrangement of positioning the grille element 14 provided with the convex protrusion adjacent to the volute member 13 to overcome the deflection of the airflow under the influence of the potential energy and reduce the flowing separation formed during the flowing of the airflow through the grille element 14. Since the airflow would be deflected gradually while the airflow is flowing from one side of the air outlet 112 that is adjacent to the volute shell 12 to another side thereof under the reaction of the kinetic potential energy during the flowing movement of the airflow, it is not suitable to have the grille elements 14 having the same morphological configuration. For example, when each grille element 14 is not provided with the convex protrusion and has a rectangular flat surface, the grille element 14 adjacent to the volute member 13 is unable to overcome the deflection of the airflow and reduce the flow separation of the airflow, resulting in the tower fan 100 failing to precisely discharge the airflow, and that when each grille element 14 is provided with the convex protrusion, the airflow would not deflected at the side of the volute member 13 adjacent to the air outlet 112 but would change its movement direction by means of the convex protrusions of the grille elements 14 that causes the airflow failing to smoothly flow out and generates airflow separation and noise.

Further, by arranging the grille elements 14 at the air outlet 112, when the airflow strikes the grille elements 14 while flowing through the air outlet 112, there is a phase difference when the airflow strikes the grille element 14 according to the morphological configuration of the grille elements 14 at the air outlet 112, so that the frequency of the airflow and the dispersing noise at the second harmonic can be greatly reduced, wherein the distance between the grille element 14 provided with the convex protrusion and the volute member 13 is smaller than the distance between the grille element 14 not provided with the convex protrusion and the volute member 13. The convex protrusion of the grille element 14 is configured to match a flowing angle of the airflow to reduce the striking of the airflow on the grille element 14, as well as to reduce the flow separation of the airflow at the air outlet 112 due to the "Principle of the Coandă Effect", thereby reducing the corresponding aerodynamic noise.

Preferably, the number of the grille element 14 provided with the convex protrusion is more than the number of the grille element 14 not provided with the convex protrusion. According to the preferred embodiment of the present invention, the number of the grille element 14 is 5, and the number of the grille element 14 provided with the convex protrusion is 3, wherein when the airflow flows through the two grille elements 14 not provided with the convex protrusion, since the airflow deflection is smaller, the flowing direction of the airflow is the consistent with the two grille elements 14 not provided with the convex protrusion, so as to prevent the airflow from striking the grille elements 14 and generating noise, wherein when the airflow flows through the three grille elements 14 each provided with the convex protrusion, the convex protrusions provide have a guiding effect to the airflow due to the deflection of the airflow, so as to overcome the deflection of the airflow and reduce the flow separation generated when the airflow flows through the grille elements 14 provided with the convex protrusion, thereby avoiding the noise caused by the flow separation of the airflow and the inaccuracy of the flowing direction of the air supply of the tower fan 100 due to deviation of the airflow.

In particular, a distance between two adjacent grille elements 14 is set to be greater than or equal to 6 mm and less than or equal to 9 mm, so as to reduce the airflow resistance while ensuring the operation safety of the tower fane 100, thereby ensuring the operation safety and performance of the tower fan 100.

In other words, the tower fan 100 allows the air flowing smoothly in the air channel 1 to ensure excellent air supply efficiency according to the morphological configuration of the air channel 1 of the tower fan 100, specifically, including the morphological configuration of the volute member 13, the morphological configuration of the volute shell 12, the positional relationship between the volute member 13 and the volute shell 12, the positional arrangement of the volute member 13 and the volute shell 12 in the housing 11, the positional relationship between the volute member 13 and the air blower 2, and the positional relationship between the volute shell 12 and the air blower 2, and the shapes of the grille elements 14 and the arrangement of the grille elements 14 at the air outlet 112. In addition, since no eddy airflow is formed in the air channel 1 due to the smooth airflow, the working noise is minimized, thereby the airflow strength and the working noise level are accounted to achieve a balance and an excellent practicability.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An air channel arrangement for accommodating an air blower having a cylindrical shape therein, including:

a housing defining an air channel therein and having an air inlet, an air outlet and an air blower installation space, wherein the air blower installation space is a cylindrical space formed and arranged for accommodating the air blower for generating an air flow to flow through the air channel and guided by the air channel, wherein a diameter of the air blower installation space is R1;

a volute shell including an air intake portion extending from a side thereof adjacent to the air inlet in a direction gradually towards the air blower installation space; and a volute member which is a cylindrical body having a curved surface portion, wherein the volute shell and the volute member are opposingly and correspondingly arranged on two sides of the air outlet respectively while a gap is retained between the volute member and the air blower, such that the volute shell and the volute member incorporate with each other to provide a guiding of the airflow within the housing so as to ensure a flow of the airflow in the air channel while preventing a backflow of air repeatedly in the air channel and avoiding a formation of eddy airflow, wherein the curved surface portion of the volute member is a partial side surface of the volute member and configured to guide the airflow in the air channel, wherein a diameter of the volute member where the curved surface portion is provided is larger than the diameter of the bottom of the air blower installation space R1, wherein a radius of a bottom surface of the volute member where the curved surface portion is located is R2, wherein R1/10≤R2≤R1/9, wherein an edge curvature length of the curved surface portion is L1, wherein R1/5≤L1≤3R1/10.

2. The air channel arrangement, as recited in claim 1, wherein a minimum distance between the curved surface portion and the air blower installation space is greater than or equal to 3 mm and less than or equal to 6 mm.

3. The air channel arrangement, as recited in claim 1, wherein one side of the curved surface portion adjacent to the air outlet is an airflow facing side, wherein the curved surface portion is folded away from the air blower installation space at a position (3/4±1/8) L1 distanced from the airflow facing side to form a step configuration of the covered surface portion.

4. The air channel arrangement, as recited in claim 3, wherein the volute member includes an airflow facing and diverting portion curvedly extending from the airflow facing side of the curved surface portion to a side of the air outlet in a direction gradually away from the air blower installation space.

5. The air channel arrangement, as recited in claim 4, wherein the volute member includes an airflow guiding diffuser portion extending from another side of the curved surface portion towards the air inlet in a direction gradually away from the air flower installation space, wherein the another side of the curved surface portion extended from the airflow guiding diffuser portion is an airflow outlet side.

6. The air channel arrangement, as recited in claim 1, wherein one side of the air intake portion adjacent to the air inlet is a heading side while the other side of the air intake portion is a tail side, wherein an included angle between a connecting line extended between the head side and a centerline of the air blower installation space on the same horizontal plane and a connecting line extended between the tail side and the centerline of the air blower installation space on the same horizontal plane is greater than or equal to 10° and less than or equal to 30°.

7. The air channel arrangement, as recited in claim 6, wherein on the same horizontal plane, a distance between the head side of the air intake portion and the centerline of the air blower installation space in a vertical direction is greater than or equal to 4R1/5 and less than or equal to R1, and that a distance between the tail side of the air intake portion and the centerline of the air blower installation space in the vertical direction is greater than or equal to R1 and less than or equal to 6R1/5.

8. The air channel arrangement, as recited in claim 7, wherein the volute shell includes a flow guiding portion curvedly extending from the tail side of the air intake portion to the air outlet in a direction gradually away from the air blower installation space.

9. The air channel arrangement, as recited in claim 8, wherein a distance between the volute shell and the air blower installation space is greater than or equal to 3 mm and less than or equal to 8 mm.

10. The air channel arrangement, as recited in claim 9, wherein an included angle between a connecting line extended between the airflow outlet side of the curved surface portion and the centerline of the air blower installation space on the same horizontal plane and a connecting line extended between the head side of the air intake and the centerline of the air blower installation space on the same horizontal plane is an air inlet angle which is greater than or equal to 120° and less than or equal to 160°.

11. The air channel arrangement, as recited in claim 10, wherein an included angle between a connecting line of the airflow facing side of the curved surface portion and the centerline of the air blower installation space on the same horizontal plane and a connecting line of a side extending from the flow guiding portion to the air outlet and the centerline of the air blower installation space on the same horizontal plane is an air outlet angle of the air channel, wherein the air outlet angle is greater than or equal to 20° and less than or equal to 40°.

12. The air channel arrangement, as recited in claim 1, wherein a width of the air outlet is greater than or equal to 5R1/9 and less than or equal to 6R1/9.

13. The air channel arrangement, as recited in claim 12, wherein the air outlet is provided with a predetermined number of grille element N, wherein N is an odd number.

14. The air channel arrangement, as recited in claim 13, wherein a distance between two adjacent grille elements of the predetermined number of grille elements is greater than or equal to 6 mm and less than or equal to 9 mm.

15. The air channel arrangement, as recited in claim 14, wherein at least one of the predetermined number of grille elements is a first grille element provided with a convex protrusion on one side thereof facing the volute member and at least one of the predetermined number of the grille elements is a second grille element not provided with the convex protrusion, wherein a radius of the convex protrusion is R3, and a center angle of the convex protrusion is greater than or equal to 120° and less than or equal to 160°.

16. The air channel arrangement, as recited in claim 15, wherein a distance between the first grille element provided with the convex protrusion and the volute member is smaller than a distance between the second grille element not provided with the convex protrusion and the volute member.

17. The air channel arrangement, as recited in claim 16, wherein a number of the first grille element provided with the convex protrusion is greater than a number of the second grille element not provided with the convex protrusion.

* * * * *